US008151531B2

(12) United States Patent
Behloul et al.

(10) Patent No.: US 8,151,531 B2
(45) Date of Patent: Apr. 10, 2012

(54) THERMAL BARRIER

(75) Inventors: Mouloud Behloul, Paris (FR); Alain Birault, Paris (FR); Jacques Daliphard, Yerres (FR); André Pouget, Paris (FR)

(73) Assignee: Lafarge, Paris (FR)

( * ) Notice: Subject to any disclaimer, the term of this patent is extended or adjusted under 35 U.S.C. 154(b) by 919 days.

(21) Appl. No.: 11/922,873

(22) PCT Filed: Jun. 23, 2006

(86) PCT No.: PCT/FR2006/001445

§ 371 (c)(1),
(2), (4) Date: Apr. 9, 2008

(87) PCT Pub. No.: WO2007/003739

PCT Pub. Date: Jan. 11, 2007

(65) Prior Publication Data

US 2009/0056260 A1 Mar. 5, 2009

(30) Foreign Application Priority Data

Jun. 30, 2005 (FR) ..... 05 06743

(51) Int. Cl.
*E04B 1/74* (2006.01)

(52) U.S. Cl. ..... 52/405.3; 52/309.7; 52/309.16

(58) Field of Classification Search ..... 52/405.3, 52/309.7, 309.16, 334, 336, 293.1
See application file for complete search history.

(56) References Cited

U.S. PATENT DOCUMENTS

| | | | | | |
|---|---|---|---|---|---|
| 2,078,969 | A * | 5/1937 | Patterson | 52/165 |
| 4,823,534 | A * | 4/1989 | Hebinck | 52/742.14 |
| 4,909,002 | A * | 3/1990 | Clifton et al. | 52/100 |
| 5,038,541 | A * | 8/1991 | Gibbar, Jr. | 52/295 |
| 5,095,674 | A * | 3/1992 | Huettemann | 52/405.3 |
| 5,401,793 | A * | 3/1995 | Kobayashi et al. | 524/401 |
| 5,864,999 | A * | 2/1999 | Wallin | 52/293.1 |
| 6,134,853 | A * | 10/2000 | Haener | 52/405.2 |
| 7,007,434 | B1 * | 3/2006 | Danielsson | 52/426 |

FOREIGN PATENT DOCUMENTS

| | | |
|---|---|---|
| DE | 34 22 905 | 1/1986 |
| DE | 87 17 953 | 10/1991 |
| DE | 40 40 433 | 6/1992 |
| DE | 195 08 292 | 9/1996 |
| DE | 196 52 165 | 6/1998 |
| EP | 0 658 660 | 6/1995 |
| EP | 0 933 482 | 8/1999 |

* cited by examiner

*Primary Examiner* — Basil Katcheves
(74) *Attorney, Agent, or Firm* — Pillsbury Winthrop Shaw Pittman, LLP

(57) ABSTRACT

A thermal barrier includes a thermal insulating block, a layer of ultra-high performance fibered concrete integrated with the block, reinforcements embedded in the layer of ultra-high performance fibered concrete, the reinforcements protruding from the ultra-high performance fibered concrete on either side of the block. Embodiments of the invention further provides a building that includes the barrier, a process of manufacturing the barrier and a manufacturing process of the building.

30 Claims, 3 Drawing Sheets

THERMAL BARRIER

CROSS-REFERENCE TO RELATED APPLICATIONS

This application is the National Phase of International Application No. PCT/FR2006/001445, filed Jun. 23, 2006, which claims priority to French Application No. 0506743, filed Jun. 30, 2005, the entire contents of both applications being hereby incorporated by reference.

BACKGROUND

1. Field of the Invention

The invention relates to a thermal barrier in the field of building construction. The invention further relates to a building comprising the barrier as well as a manufacturing process of the barrier and a construction process of the building.

2. Description of Related Art

Insulation of a building can be done on the interior side of a building or on the exterior side. When the insulation is done on the interior side, insulating panels are fixed against the walls, from the floor to the ceiling of a story. However there is the problem to insulate the joint between the wall and a slab forming the floor or the ceiling. Indeed, if there is no insulation between the slab and the wall, both concrete, a thermal bridge occurs; calories escape for example from the interior of the building towards the exterior through the slab and the wall. The thermal insulation of the building is then defective.

SUMMARY

There is a need for thermal insulation of buildings to be more efficient.

For this the invention proposes a thermal barrier comprising:

a thermal insulating block, a layer of ultra-high performance fibered concrete, integrated with the block, reinforcements embedded in the layer of ultra-high performance fibered concrete, the reinforcements protruding from the ultra-high performance fibered concrete on either side of the block.

According to one variant, the reinforcements are of steel.

According to one variant, the reinforcements are of stainless steel.

According to one variant, the block comprises several surfaces, the layer of ultra-high performance fibered concrete covering one surface of the insulating block.

According to one variant, the block comprises several surfaces, the layer covering two adjacent surfaces.

According to one variant, the barrier further comprises a protection barrier against fire, the barrier being on one side of the layer opposite the side in contact with the insulating block.

According to one variant, the insulating block is of expanded polystyrene.

According to one variant, the barrier is a piece of construction.

According to one variant, the layer has a size comprised from 5 to 40 mm.

According to one variant, the layer comprises protruding ribs from the side of the layer in contact with the block, the reinforcements being embedded in the ribs.

The invention further relates to a building comprising the barrier such as described previously, a wall, a slab connected to the wall by the barrier.

According to one variant, the barrier is continuous between the slab and the wall, along the edge of the slab.

According to one variant, the slab is fixed to the wall by the barrier's reinforcements.

According to one variant, the barrier's reinforcements are in the lower half of the slab.

According to one variant, the barrier further comprises an Interior Thermal Insulation, comprising a lining complex comprising at least one gypsum board.

The invention further relates to a manufacturing process of the barrier such as previously described, comprising the steps of formwork for the insulation block in a channel, pouring a layer of ultra-high performance fibered concrete on one side of the block, positioning reinforcements in the layer of ultra-high performance fibered concrete.

According to one variant, there is a space between the block and one formwork of the channel, the ultra-high performance fibered concrete being poured in the space as well as on the block.

The invention further relates to a process of construction of a building, comprising the steps of pouring a wall, positioning the barrier such as previously described, the protruding reinforcements on one side of the barrier being positioned on the wall, pouring the slab, the protruding reinforcements on the other side of the barrier setting with the slab.

BRIEF DESCRIPTION OF THE DRAWINGS

Other characteristics and advantages of the invention will appear when reading the detailed description that follows of the ways of carrying out the invention, given as examples only and referring to the drawings that show.

DETAILED DESCRIPTION

The invention relates to a thermal barrier comprising a thermal insulating block and a layer of ultra-high performance fibered concrete integrated with the block. The barrier further comprises reinforcements embedded in the layer of ultra-high performance fibered concrete, the reinforcements protruding from the layer on either side of the block. The advantage is that the thermal bridge is reduced to the layer of concrete, which reduces the thermal bridge; furthermore the barrier is easy to position.

Figure 1:
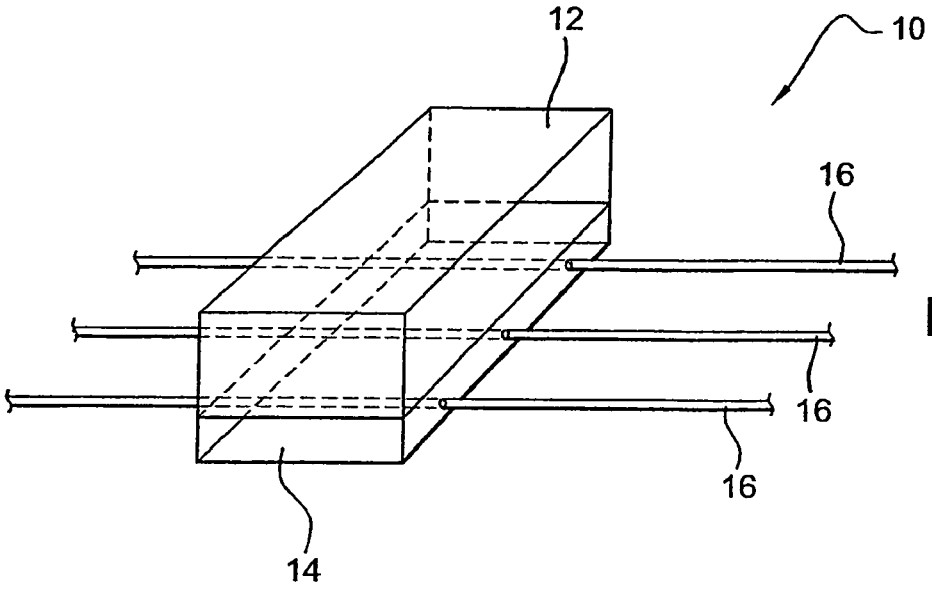
FIG. 1, one construction of the thermal barrier.

FIG. 1 shows the barrier 10 according to one construction. The barrier 10 comprises a thermal insulating block 12 and a layer 14 of ultra-high performance fibered concrete. The barrier 10 further comprises reinforcements 16 embedded in the layer 14; the reinforcements 16 protruding on either side of the layer. The barrier 10 can be an interior or exterior element of thermal insulation; the barrier 10 is particularly positioned at the junction of a slab and a side of a wall, as will be further described with reference to FIG. 2. The thermal barrier 10 favors a reduction of the existing thermal bridge between the slab and the wall. The barrier 10 reduces the passage of calories through the slab and the wall.

The layer 14 is constructed in ultra-high performance fibered concrete (abbreviation: UHPFC). The layer 14 is for example from 5 to 40 mm in size, which permits embedding of the reinforcements 16 and at the same time is thin enough to limit the thermal bridge between the slab and the wall through the barrier 10. Preferably, the layer 14 is 7 mm in size. This allows the reinforcements to be embedded and positioned as close as possible to the lower surface of the slab.

The ultra-high performance fibered concretes are concretes with a cement matrix containing fibers. The document <<Bétons fibrés à ultra-hautes performance)>> from the <<Service d'études techniques des routes et autoroutes (Setra)>> and the <<Association Française de Génie Civil (AFGC)>> can be referred to. The strengths of these concretes to compression are generally higher than 150 MPa, even 250 MPa. The fibers are metallic, organic or a mixture. The dosage of binder is high (the W/C ratio is low, in general the W/C ratio is at most approximately 0.3).

The cement matrix in general comprises cement (Portland), an element with a pozzolanic reaction (notably silica fumes) and a fine sand. The respective dimensions are selected intervals, according to the respective nature and amounts. For example, the cement matrix can comprise:

Portland cement fine sand a type of element such as silica fumes optionally quartz meal the amounts being variable and the dimension of the various elements being selected from among a micronic or submicronic range and the millimeter, with a maximum dimension not generally exceeding 5 mm.

a superplasticizer being generally added with the mixing water.

As an example of a cement matrix, those described in the patent applications EP-A-518777, EP-A-934915, WO-A-9501316, WO-A-9501317, WO-A-9928267, WO-A-9958468, WO-A-9923046, WO-A-0158826 can be mentioned, in which further details can be found.

The fibers have length and diameter characteristics such that they indeed confer the mechanical characteristics. Their quantity is generally low, for example from 1 to 8% in volume.

Examples of matrices are the RPC, Reactive Powder Concretes, while the examples of UHPFC are BSI concretes by Eiffage, Ductal® by Lafarge, Cimax® by Italcementi and BCV by Vicat.

Specific examples are the following concretes:

1) those resulting from mixtures of a—a Portland cement selected in the group comprising the ordinary cements called "OPC", the high performance Portland cements, called "OPC-HP", the high performance and rapid setting Portland cements, called "OPC-HPR" and the Portland cements with a low content of tricalcium aluminate (C3A), normal or high performance and rapid setting types;

b—a vitreous micro silica wherein the particles for a major part have a diameter comprised in the range of 100 A-0.5 microns, obtained as a by-product in the zirconium industry, the proportion of this silica being from 10 to 30 weight % of the cement;

c—a water-reducing superplasticizer and/or a fluidizing agent in an overall proportion from 0.3% to 3% (weight of the dry extract related to the weight of the cement);

d—a quarry sand comprising particles of quartz that have for a major part a diameter comprised in the range 0.08 mm-1.0 mm;

e—optionally other admixtures.

2) those resulting from the mixture of:

a—a cement with a particle size distribution corresponding to a mean harmonic diameter or equal to 7 μm, preferably comprised from 3 to 7 μm;

b—a mixture of calcined bauxite sands with different particle size distributions, the finest sand having an average particle size distribution lower than 1 mm and the coarsest sand having an average particle size distribution lower than 10 mm;

c—silica fumes wherein 40% of the particles have a dimension lower than 1 μm, the mean harmonic diameter being close to 0.2 μm, and preferably to 0.1 μm;

d—an anti-foaming agent;

e—a water-reducing superplasticizer;

f—optionally fibers;

and water;

the cements, the sands and the silica fume presenting a particle size distribution such that there are at least three and at most five different particle size distribution classes, the ratio between the mean harmonic diameter of one particle size distribution and the class immediately above being approximately 10.

3) those resulting from the mixture of:

a—a Portland cement;

b—granular elements;

c—fine elements with a pozzolanic reaction;

d—metallic fibers;

e—a dispersing agent;

and water;

the preponderant granular elements have a maximum D particle size at most equal to 800 micrometers, wherein the preponderant metallic fibers have an individual length l comprised in the range 4 mm-20 mm, wherein the ratio R between the average length L of the fibers and the aforesaid maximum D size of the granular elements is at least equal to 10 and wherein the quantity of preponderant metallic fibers is such that the volume of these fibers is from 1.0% to 4.0% of the volume of the concrete after setting.

4) those resulting from the mixture of:

a—100 p. of Portland cement;

b—30 to 100 p., or better 40 to 70 p., of fine sand having a particle size of at least 150 micrometers;

c—10 to 40 p. or better 20 to 30 p. of amorphous silica having a particle size lower than 0.5 micrometers;

d—20 to 60 p. or better 30 to 50 p., of ground quartz having a size of particles lower than 10 micrometers;

e—25 to 100 p., or better 45 to 80 p. of steel wool;

f—a fluidizer, g—13 to 26 p., or better 15 to 22 p., of water.

Thermal curing is included.

5) those resulting from the mixture of:

a—cement;

b—granular elements having a maximum Dmax particle size of at most 2 mm, preferably at most 1 mm;

c—elements with a pozzolanic reaction having a size of elementary particles of at most 1 μm, preferably at most of 0.5 μm;

d—constituents capable of improving the tenacity of the selected matrix from among acicular or plate-like elements having an average size of at most 1 mm, and present in a volume proportion comprised from 2.5 to 35% of the cumulated volume of the granular elements (b) and the elements with a pozzolanic reaction (c);

e—at least one dispersing agent and meeting the following conditions:

(1) the weight percentage of water E related to the cumulated weight of the cement (a) and elements (c) is comprised in the range of 8-24%; (2) the fibers present an individual length L of at least 2 mm and a L/phi ratio, phi being the diameter of the fibers, of at least 20; (3) the R ratio between the average length L of the fibers and the maximum Dmax particle size of the granular elements is at least 10; (4) the quantity of fibers is such that their volume is lower than 4% preferably 3.5% of the volume of concrete after setting.

6) those resulting of the mixture of:

a—cement;

b—granular elements;

c—elements with a pozzolanic reaction having a size of elementary particles of at most 1 μm, preferably at most 0.5 μm;

d—constituents capable of improving the tenacity of the selected matrix from among the acicular or plate-like elements having an average size of at most 1 mm, and present in a volume proportion comprised from 2.5 to 35% of the cumulated volume of the granular elements (b) and the elements with a pozzolanic reaction (c);

e—at least one dispersing agent;

and meeting the following conditions: (1) the weight percentage of water E related to the cumulated weight of the cement (a) and elements (c) is comprised in the range of 8-24%; (2) the fibers present an individual length L of at least 2 mm and a L/phi ratio, phi being the diameter of the fibers, of at least 20; (bis) the ratio R between the average length L of the fibers and the size of the D75 particle of all the constituents (a), (b), (c) and (d) is at least 5, preferably at least 10; (4) the quantity of fibers is such that their volume is lower than 4% preferably than 3.5% of the volume of concrete after setting; (5) all the elements (a), (b), (c) and (d) present a D75 particle size of at most 2 mm, preferably at least most 1 mm, and a D50 particle size of at most 200 μm preferably at most 150 p.m.

7) those resulting from the mixture of:

a—cement;

b—granular elements having a maximum particle size D of at most 2 mm, preferably at most 1 mm;

c—fine elements with a pozzolanic reaction having a size of elementary particles of at most 20 μm, preferably at most 1 μm;

d—at least one dispersing agent;

and meeting the following conditions: (e) the weight percentage of water related to the cumulated weight of the cement (a) and the elements (c) is comprised from 8 to 25%; (f) the organic fibers present an individual length L of at least 2 mm and a ratio L/phi, phi being the diameter of the fibers, of at least 20; (g) the ratio R between the average length L of the fibers and the maximum particle size D of the granular elements is at least 5, h) the quantity of fibers is such that their volume represents at most 8% of the volume of the concrete after setting.

8) those resulting from the mixture of:

a—cement;

b—granular elements;

c—elements with pozzolanic reactions having a size of elementary particles of at most 1 μm, preferably at most of 0.5 μm;

d—at least one dispersing agent;

and meeting the following conditions: 1) the weight percentage of water E related to the cumulated weight of the cement C (a) and the elements (c) is comprised within the range of 8-24%; (2) the fibers present an individual length L of at least 2 mm and a L/phi ratio, phi being the diameter of the fibers of at least 20; (3) the R ratio between the average length L of the fibers and the size of the D75 particle of all the constituents (a), (b) and (c) is at least 5, preferably at least 10; (4) the quantity of fibers is such that their volume is at most 8% of the volume of the concrete after setting; (5) all the elements (a), (b) and (c) present a size of the D75 particle of at most 2 mm, preferably at most 1 mm, and a D50 particle size of at most 150 μm, preferably at most 100 μm.

9) those resulting from the mixture of:

a—at least one hydraulic binder from the group comprising the Portland cements class G (API), the Portland cements class H (API) and the other hydraulic binders with low levels of aluminates, b—a micro silica with a particle size distribution comprised within the range of 0.1 to 50 micrometers, from 20 to 35 weight % related to the hydraulic binder, c—an addition of average mineral and/or organic particles, with particle size distributions comprised within the range of 0.5-200 micrometers, from 20 to 35 weight % related to the hydraulic binder, the amount of the aforesaid addition of average particles being lower or equal to the amount of micro silica, —a superplasticizing and/or water-soluble fluidizing agent in a proportion comprised from 1% to 3 weight % related to the hydraulic binder, and water in amounts at the most equal to 30 weight % of the hydraulic binder.

10) those resulting from the mixture of:

a—cement;

b—granular elements having a Dg particle size of at most 10 mm;

c—elements with a pozzolanic reaction having a size of elementary particles comprised from 0.1 to 100 μm;

d—at least one dispersing agent;

e—metallic and organic fibers;

and meeting the conditions: (1) the weight percentage of water related to the cumulated weight of the cement (a) and the elements (c) is comprised within the range of 8-24%; (2) the metallic fibers present an average length Lm of at least 2 mm, and a h/d1 ratio, d1 being the diameter of the fibers, of at least 20; (3) the Vi/V ratio of the volume Vi of the metallic fibers to the volume V of the organic fibers is higher than 1, and the Lm/Lo ratio of the length of the metallic fibers to the length of the organic fibers is higher than 1; (4) the ratio R between the average length Lm of the metallic fibers and the Dg size of the granular elements is at least 3; (5) the quantity of metal fibers is such that their volume is lower than 4% of the volume of the concrete after setting and (6) the organic fibers present a melting temperature lower than 300° C., an average length Lo higher than 1 mm and a Do diameter of at most 200 μm, the amount of organic fibers being such that their volume is comprised from 0.1 to 3% of the volume of the concrete.

A thermal cure can be done on these concretes. For example, the thermal cure comprises, after the hydraulic setting, heating to 90° C. temperature or more for several hours, typically 90° C. for 48 hours.

Returning to FIG. 1, block 12 provides thermal insulation; the material used is for example expanded polystyrene. Block 12 is integrated with the layer 14 of the UHPFC. For example the layer 14 of the UHPFC sets around the insulating block 12 which makes the layer 14 and block 12 bond with each other. In particular, layer 14 and block 12 are consolidated so as to be transported together. More generally, the block is bonded to the layer in a reversible manner or not; the block is fixed or only juxtaposed to the layer. Block 12 comprises several surfaces, layer 14 being bonded to one surface of block 12. In this way a composite is obtained with two stratums. Block 12 is preferably a substantially regular parallelepiped, which allows the barrier 10 to be inserted between the edge of the slab and the wall (the edge of the slab is the side of the slab facing the wall). The barrier 10 can be dimensioned to appear as a prolongation of the slab towards the wall. In a transversal cut, block 12 is the width of the layer 14; the barrier then has a regular transversal cut, which simplifies insertion between the edge of the slab and the wall. Preferably, the width of the barrier in a transversal cut, corresponding to the distance between the edge of the slab and the wall, is from 4 to 10 cm.

The reinforcements 16 protrude on each side of the barrier 10; when the barrier 10 is inserted, the reinforcements 16 set on the one hand with the wall and on the other with the slab 20. The reinforcements are embedded in the UHPFC; the reinforcements are covered by the concrete or are located at the very surface of the layer of concrete. The reinforcements 16 can be in stainless steel, which protects them against oxidation. Nevertheless, when the reinforcements 16 are embedded in such a way that they are covered by the concrete, the reinforcements 16 are protected against humidity and oxidation; therefore, a classic steel can be used for the reinforcements 16 which makes production of the barrier 10 less expensive. Additionally, according to FIG. 1, the layer 14 of the UHPFC is seen to be the width (in a transversal cut) of the barrier; the reinforcements 16 are therefore maintained in the layer 14 of the UHPFC on the entire width of the barrier 10, from the edge of the slab to the wall. This provides good support from the reinforcements to the barrier.

The barrier 10 is a piece of construction; the barrier 10 can be manufactured at a different site than where the barrier 10 is going to be installed. Block 12 and the layer 14 of the UHPFC being bonded together, it is possible to transport the barrier 10 to the location where the barrier 10 is to be installed. The barrier 10 can be delivered in the desired size then installed at the appropriate time. The barrier 10 can be handled independently. The barrier 10 can also be delivered in a larger size, then shortened to correspond to its location.

The size of the barrier 10 is determined according to the thermal insulation to be ensured. For example, the size of the barrier 10 between the edge of the slab and the wall can be from 4 to 10 cm.

Figure 2:
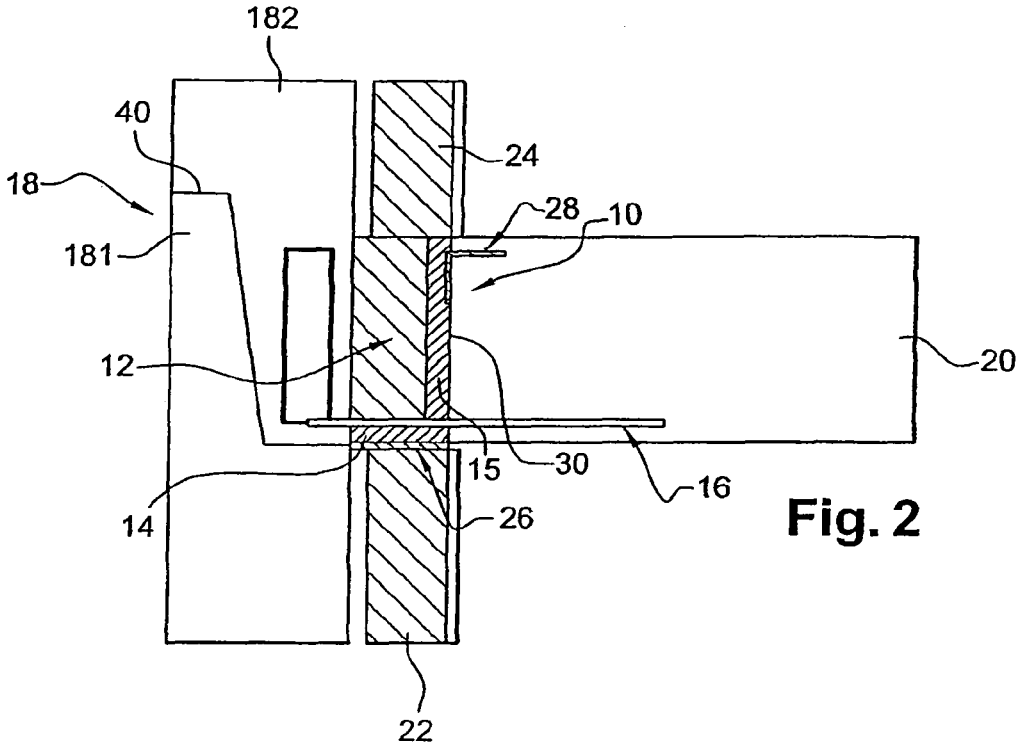
FIGS. 2 and 8, the thermal barrier in place in a building.

FIG. 2 shows the barrier 10 in position in a building. In FIG. 2 a vertical wall 18 is shown on which the edge 30 of a floor slab 20 rests; the barrier 10 is inserted between the slab 20 and the wall 18. As an example, the slab 20 is on the inside of the wall 18. The thermal bridge therefore likely to occur between the slab 20 and the wall 18 is limited, the bridge being influenced by the sole layer 14 of the UHPFC. FIG. 2 also shows two other thermal insulating blocks 22 and 24 that correspond to the building's inside insulation, on either side of the slab 20; the barrier 10 ensures continuing insulation of the building between the slab 20 and the wall 18 and also guarantees the load-bearing capacity of the slab 20. The insulation is therefore no longer disturbed by a structure junction such as that of the slab and the wall.

The slab 20 is fixed to the wall by the reinforcements 16 of the barrier 10. The barrier 10 therefore not only reduces the thermal bridge by also fixes the slab 20. The part of the reinforcements 16 located in the slab 20 and the wall 18 can be in different forms, as shown in FIG. 2. Indeed, the reinforcements 16 can be rectilinear as is the case of the part of the reinforcements 16 in the slab 20. This allows the slab 20 to be maintained over a great length. The reinforcements can equally be curved, as is the case of the part of the reinforcements 16 in the wall. The reinforcements 16 are bent in the optional shape of a hook, which provides a good anchor for the reinforcements in the wall; moreover, the hook reinforcements provide an anchorage to a wall when the latter is of a low area compared to the slab 20.

The barrier 10 is preferably positioned in such a way that the layer 14 of the UHPFC is located under the insulating block 12; this makes it possible to place the reinforcements 16 in the lower half of the slab 20 so that the latter is better maintained by the reinforcements 16. Additionally, the layer 14 of the UHPFC being thin, this ensures the positioning of the reinforcements 16 very close to the lower surface of the slab 20, which favors its support.

The barrier 10 is preferably continuous between the slab 20 and the wall. In FIG. 2, the barrier 10 is continuous in a perpendicular direction from the diagram of the figure. The barrier is continuous along the edge 30 of the slab. Hence, only the barrier 10 ensures a connection between the slab 20 and the wall 18; the edge 30 of the slab 20 is not prolonged to the wall which on the one hand makes the slab 20 easier to construct and on the other hand prevents the creation of a thermal bridge by contact of the concrete in the slab 20 with the concrete in the wall 18.

On FIG. 2, the barrier 10 can also comprise a thermal barrier 26. The thermal barrier 26 is a protection against fire. The barrier 26 is located on one side of the layer 14 of the UHPFC that is not in contact with the insulating block 12. The barrier 26 is placed under the barrier 10. The barrier 26 is placed between the barrier 10 and the insulating block 22. If a fire should begin in the building, the insulating block 22 would be rapidly destroyed but the barrier 26 would protect the reinforcements of the barrier 10 against the fire. Additionally, the barrier 26 would also reduce the thickness of the layer 14 of the UHPFC; the presence of the barrier 26 indeed does not require the reinforcements 16 to be kept as far away as possible from the lower side of the barrier 10 to protect them from the fire which would require a thicker layer 14 of UHPFC. With the barrier 26, the reinforcements 16 can be lower than the barrier 10, which reduces the size of the layer 14 of the UHPFC.

Figure 3:
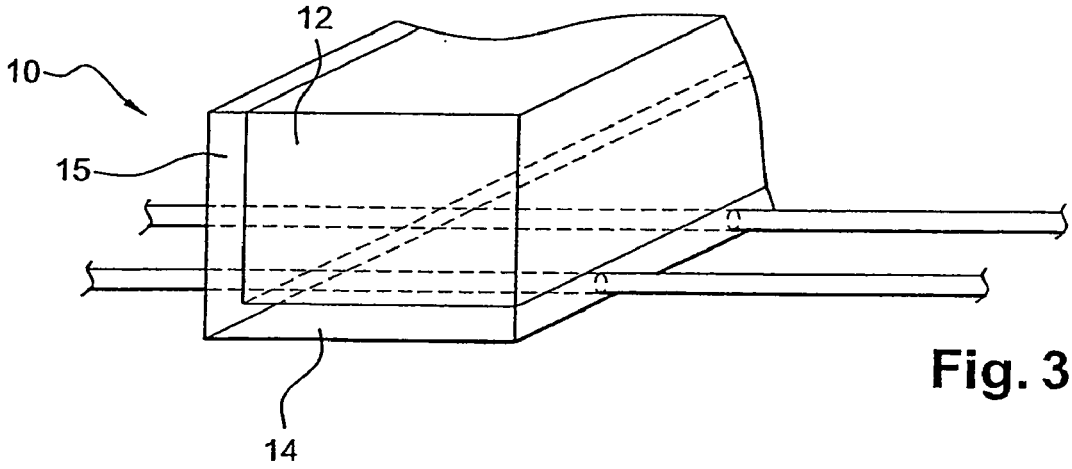
FIGS. 3 and 4, improvements of the thermal barrier.

FIG. 2 shows an improvement that can be made to the barrier 10 in FIG. 1, equally represented in FIG. 3. According to FIGS. 2 and 3, the barrier 10 covers two adjacent sides of block 12. A vertical layer 15 of the UHPFC is in contact with the side of the slab edge 20 facing the wall 18; a horizontal layer 14 of the UHPFC is from the slab 20 to the wall 18, in which the reinforcements are embedded. This provides a better transfer of loads going through the slab 20. The loads of the slab 20 are indeed transferred by the vertical layer 15 of the UHPFC and are transmitted in the wall by the means of the horizontal layer 14 of the UHPFC. More specifically, the two layers 14 and 15 of the UHPFC form an <<L>>. The insulating block 12 is located in the <<L>> to form a parallelepiped.

FIG. 2, showing the barrier 10 in <<L>> also shows an organ allowing for a better fixing of the slab 20 to the barrier 10 and therefore to the wall. This organ can be a hook 28 integrated to the barrier 10, particularly to the vertical layer 15 of the barrier 10. The hook 28 sets with the slab 20 which allows for additional fixing of the slab 20 to the barrier 10 and therefore improves the fixing of the slab 20.

Figure 4:
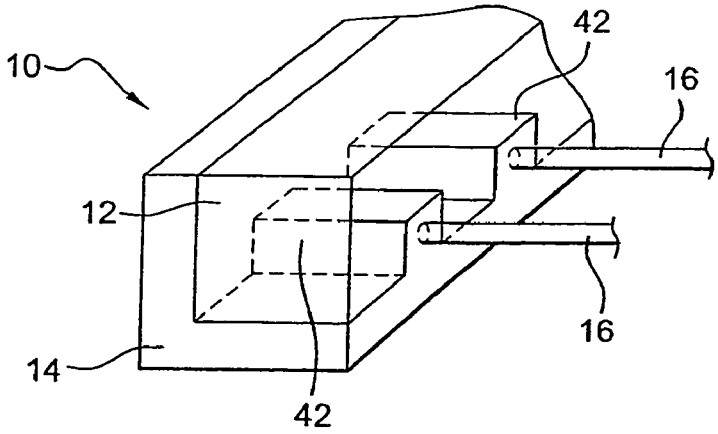

FIG. 4 shows yet another improvement that can be made to the barrier in any one of the previous figures. According to this embodiment, the layer 14 of the UHPFC in which the reinforcements 16 are embedded comprises protruding ribs 42 on the side of the layer 14 in contact with the block 12, the reinforcements 16 being embedded in the ribs. This protects the reinforcements 16 against fire by increasing the distance between the reinforcements 16 and the lower side of the barrier 10 without increasing the thickness of the layer 14. The thickness of the layer 14 of the UHPFC is only locally increased; this avoids that the layer 14 is unnecessarily thicker between the reinforcements 16, and therefore making the thermal bridge greater.

It is also possible to consider that the insulating block 12 is covered according to three of the sides, the layers of UHPFC presenting, in a cut section, a <<U>> form with the block 12 in the <<U>>.

Figure 5:
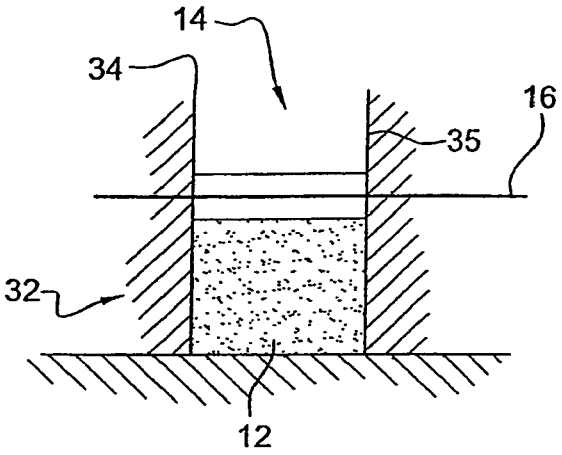
FIGS. 5 and 6, a manufacturing process of the barrier.
Figure 6:
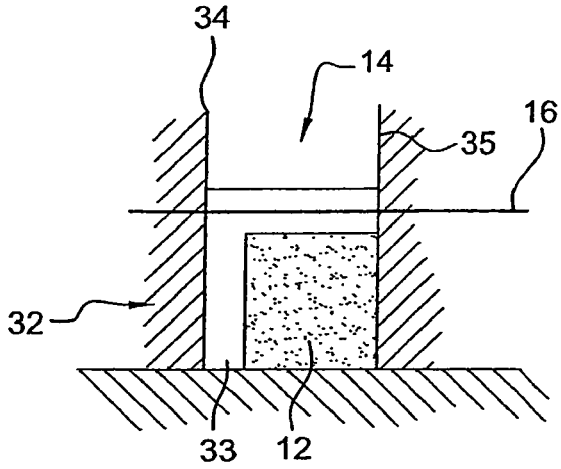

The invention also relates to a manufacturing process of the barrier 10. This process shows that manufacture of the barrier 10 is simple; in particular, this process does not need a mold of a particular form. FIGS. 5 and 6 show the manufacturing process of the barrier 10. According to FIG. 5, the thermal-insulating block 12 is encased between two formwork molds 34 and 35 in such a way as to constitute a channel 32 along the width of the block 12; the block 12 is at the bottom of the channel 32. The UHPFC is then poured in the channel 32 in order to constitute the layer 14 of UHPFC on one side of the block 12. The reinforcements 16 are positioned in the layer 14 of UHPFC in order to be maintained embedded in the layer 14 and protrude on either side of the channel 32. The formworks 34 and 35 are removed after setting of the UHPFC, the layer 14 of UHPFC having been bonded to the block 12. This process corresponds to the manufacture of the barrier 10 in FIG. 1.

According to FIG. 6, the insulating block 12 is encased between two formwork molds 34, 35 again in order to constitute a channel 32, but the width of the channel 32 is greater than the width of the block 12, according to a transversal cut section of the barrier 10. A space 33 is left between the formwork mold 34 and the block 12 along the entire length of the block 12. The UHPFC is then poured in the space 33 between the channel 32 and the block 12 in order to constitute the vertical layer 15 of the barrier 10 according to one side of the block 12; then the UHPFC is poured on the block 12 in order to constitute the horizontal layer 14 of the barrier 10. The reinforcements 16 are positioned in the horizontal layer 14 of UHPFC in order to be maintained embedded in the layer 14 and protrude on either side of the channel 32. The formwork molds 34, 35 are removed after setting of the UHPFC, the UHPFC having been bonded to the block 12.

To manufacture the barrier 10 in FIG. 4, the assembly in FIG. 6 is done. Additionally, slots are sculpted on one surface of the block 12, in order to make the surface of the block 12 irregular; the UHPFC is poured on the aforesaid irregular surface of the block 12, the reinforcements 16 being positioned in the le UHPFC in the grooves on the surface provided by irregular slots of the block.

The manufacturing process is therefore simple, notably because it does not require maintaining the block 12 in suspension while the UHPFC is poured; the block 12 is laid at the bottom of the channel 32. The process is also simple because it does not require a mold presenting a particular form. Furthermore, the manufacturing process of the barrier 10 being simple, it is possible to consider manufacturing the barrier 10 on site.

Figure 7:
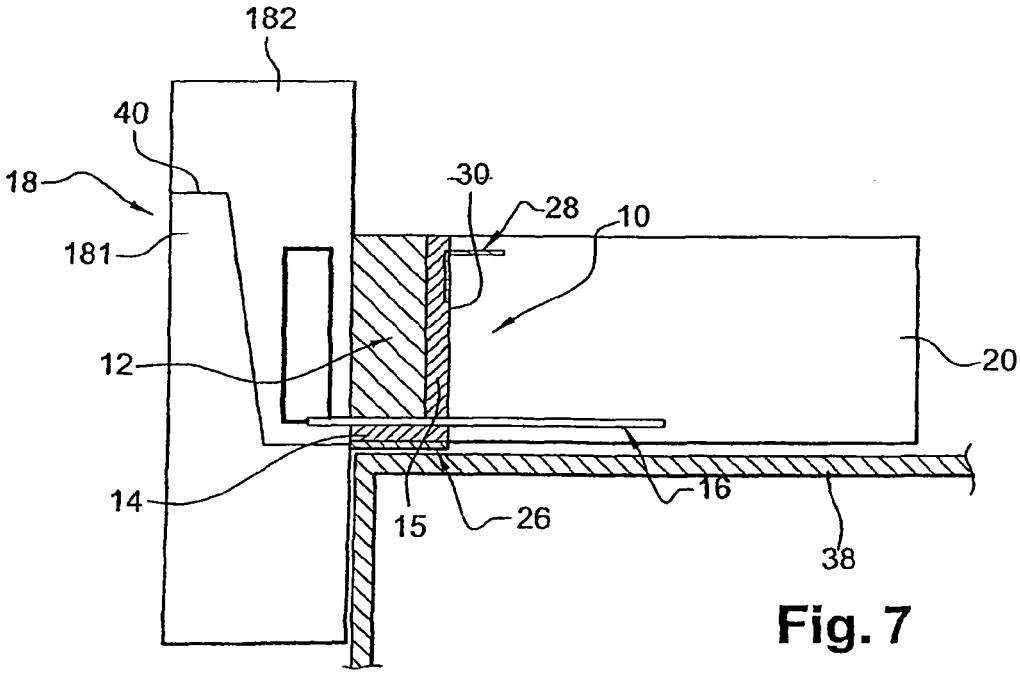
FIG. 7, a construction process of a building.

The invention also relates to a construction process of a building. This process is visible in FIG. 7. The process has the advantage of not disturbing the traditional building construction methods, which also avoids modifications of implementation times. The building comprises a wall 18 to which a slab 20 is fixed. The process comprises first of all the erection of a first part 181 of the wall 18, up to the level where the slab 20 is going to be laid. The height of this first part 181 of the wall can correspond to the height of one floor. The top of the first part 181 of the wall is seen by a stop of concrete pouring 40; this allows for a better junction with the second top part 182 of the wall to come. A support 38 is positioned against the part 181 of the wall, the barrier 10 being positioned on the support 38. The reinforcements 16 of the barrier 10 run on one side of the barrier, for example in a rectilinear manner above the support 38, and on the other side of the barrier, above the part 181 of the wall, the reinforcement being therefore in the form of a hook on this last side. Then the slab 20 is poured, setting around the rectilinear reinforcements 16. The second top part 182 of the wall is then poured above the already existing part 181 of the wall, setting around the reinforcements 16 in the form of a hook. Nevertheless, the slab 20 can be poured after the second part 182 of the wall.

Contrary to a process aimed at reducing the section of the junction between the slab 20 and the wall 18 by adding an insulating block 12 to reduce the thermal bridge between the slab 20 and the wall 18, the present process has the advantage of avoiding maintaining the block 12 while the slab 20 is being poured. The barrier 10 is positioned as a piece of construction and the slab 20 and the wall are poured while the block 12 is correctly maintained in position by the barrier 10.

Figure 8:
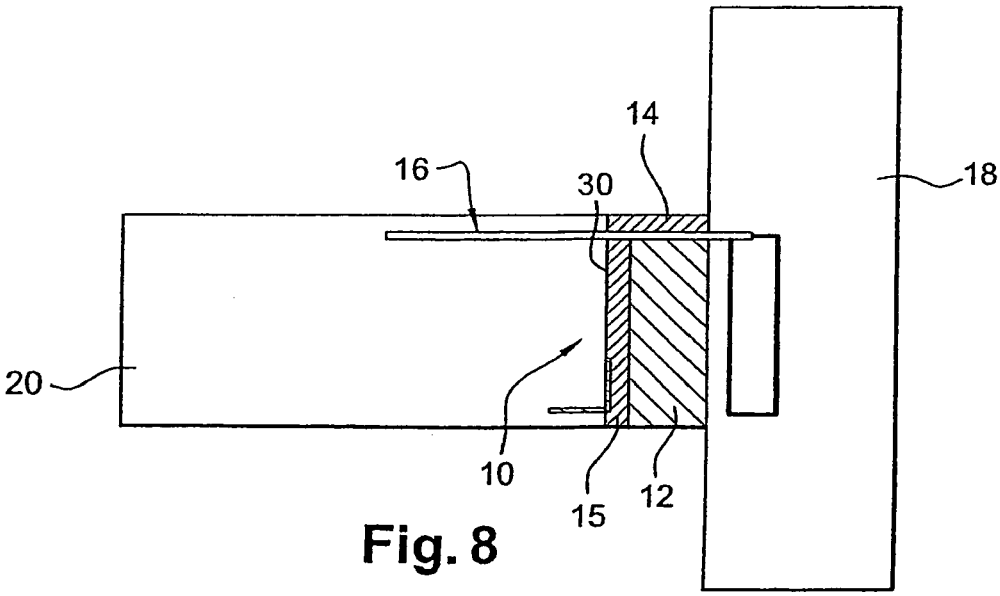

The barrier 10 and the construction process of a building can be implemented both inside and outside the building, to ensure a junction between a wall and a slab such as a balcony, a floor, cornices, etc. FIG. 8 shows a junction between the wall 18 and the slab 20 constituting a balcony. The slab 20 is then overhanging. The barrier 10 is seen to be in a reverse position compared to the one in FIG. 2; the reinforcements 16 are in the top half of the slab 20. The barrier 10 is positioned in such a way that the layer 14 is on the block 12.

The invention claimed is:

1. A thermal barrier comprising:

a thermal insulating block, said thermal insulating block including a slot that extends from a first side of the thermal insulating block to a second side of the thermal insulating block;

a layer of ultra-high performance fibered concrete integrated with the block and positioned on said first or second side of the block; and a reinforcement positioned in said slot and embedded in ultra-high performance fibered concrete in the slot, the reinforcement protruding from each of the first and second sides of the thermal insulating block so that said reinforcement is only partly covered by ultra-high performance fibered concrete, wherein a third side of the thermal insulating block forms an outer surface of the thermal barrier.

2. The barrier according to claim 1, wherein the reinforcement is of steel.

3. The barrier according to claim 1, wherein the reinforcement is of stainless steel.

4. The barrier according to claim 1, wherein the layer of ultra-high performance fibered concrete substantially covers said first or second side of the insulating block.

5. The barrier according to claim 1, wherein the layer covers two adjacent sides of the block.

6. The barrier according to claim 1, further comprising a barrier of protection against fire, the barrier of protection against fire being on one side of the layer opposite the one in contact with the insulating block.

7. The barrier according to claim 1, wherein the insulating block is of expanded polystyrene.

8. The barrier according to claim 1, the barrier being a piece of construction.

9. The barrier according to claim 1, wherein the layer has a size comprised from 5 to 40 mm.

10. The barrier according to claim 1, wherein the thermal insulating block includes a plurality of slots that extend from the first side to the second side of the thermal insulating block, the barrier comprising a plurality of reinforcements positioned in the slots and embedded in ultra-high performance fibered concrete.

11. A process for manufacturing a building, comprising:

pouring a wall;

positioning a barrier according to claim 1 near the wall, the reinforcement protruding from one side of the bather being positioned on the wall; and pouring a slab, the reinforcement protruding from the other side of the barrier setting with the slab.

12. The barrier according to claim 1, wherein the third side of the thermal insulating block is adjacent to said first or second side.

13. The barrier according to claim 1, wherein said first side or said second side of the thermal insulating block forms another outer surface of the thermal barrier and is partly devoid of a layer of concrete.

14. The barrier according to claim 1, wherein said slot forms a groove on a surface of the thermal insulating block that extends from said first side to said second side.

15. A thermal barrier comprising:

a thermal insulating block;

a layer of ultra-high performance fibered concrete integrated with the block; and reinforcements embedded in the layer of ultra-high performance fibered concrete, the reinforcements protruding from the ultra-high performance fibered concrete on either side of the layer, wherein the concrete is the result:

1) of the mixture of a—a Portland cement selected from the group consisting of the ordinary Portland cements called "OPC", the high performance Portland cements called "OPC-HP", the high performance and rapid setting cements called "OPC-HPR" and the Portland cements with low levels of tricalcium aluminate (C3A), the normal or the high performance and rapid setting type;

b—a vitreous micro silica whose particles, for a major part have a diameter comprised within the range of 100 A-0.5 micron, obtained as a by-product in the zirconium industry, the proportion of this silica being from 10 to 30 weight % of the weight of the cement;

c—a superplasticizing water-reducing agent and/or a fluidizing agent in an overall proportion from 0.3% to 3% (weight of the dry extract related to the weight of the cement);

d—a quarry sand constituted by particles of quartz that for a major part have a diameter comprised within the range of 0.08 mm-1.0 mm; and e—optional other admixtures; or 2) the mixture of a—a cement with a particle size distribution corresponding to a mean harmonic diameter comprised from 3 to 7 μm;

b—a mixture of calcined bauxite sands with different particle size distributions, the finest sand having an average particle size distribution lower than 1 mm and the coarsest sand having an average particle size distribution lower than 10 mm;

c—silica fumes of which 40% of the particles are lower than 1 μm in size, the mean harmonic diameter being close to 0.2 μm;

d—an anti-foaming agent;

e—a water-reducing superplasticizer;

f—optionally fibers;

and water;

the cements, sands and silica fumes presenting a particle size distribution such that there are at least three and at most five different particle size classes, the ratio between the mean harmonic diameter of one particle size class and the class immediately above being approximately 10; or 3) the mixture of a—a Portland cement;

b—granular elements;

c—fine elements with a pozzolanic reaction;

d—metallic fibers;

e—a dispersing agent;

and water;

the preponderant granular elements have a maximum size D at most equal to 800 micrometers, in that the preponderant metallic fibers have an individual length l comprised within the range of 4 mm-20 mm, in that the ratio R between the average length L of the fibers and the aforesaid maximum size D of the granular elements is at least equal to 10 and in that the quantity of preponderant metallic fibers is such that the volume of these fibers is from 1.0% to 4.0% of the volume of the concrete after setting; or 4) the mixture of a—100 p. of Portland cement;

b—30 to 100 p. of fine sand having a particle size of at least 150 micrometers;

c—10 to 40 p. of amorphous silica having a particle size lower than 0.5 micrometers;

d—20 to 60 p. of ground quartz having a particle size lower than 10 micrometers;

e—25 to 100 p. of steel wool;

f—a fluidizer, and g—13 to 26 p. of water, a thermal curing being specified; or 5) the mixture of a—cement;

b—granular elements having a maximum Dmax particle size of at most 2 mm;

c—elements with a pozzolanic reaction having a size of elementary particles of at most 1 μm;

d—constituents capable of improving the tenacity of the matrix selected from among the acicular or plate-like elements having an average size of at most 1 mm, and present in a volume proportion comprised from 2.5 to 35% of the cumulated volume of the granular elements (b) and elements with a pozzolanic reaction (c); and e—at least one dispersing agent and meeting the following conditions:

(1) the weight percentage of water E related to the cumulated weight of the cement (a) and the elements (c) is comprised within the range of 8-24%; (2) the fibers presenting an individual length L of at least 2 mm and a L/phi ratio, phi being the diameter of the fibers, of at least 20; (3) the R ratio between the average length L of the fibers and the maximum Dmax particle size of the granular elements is at least 10; (4) the quantity of fibers is such that their volume is lower than 4% of the volume of the concrete after setting; or 6) the mixture of a—cement;

b—granular elements;

c—elements with a pozzolanic reaction having a size of elementary particles of at most 1 μm;

d—constituents capable of improving the tenacity of the matrix selected among the acicular or plate-like elements having an average size of at most 1 mm, and present in a volume proportion comprised from 2.5 to 35% of the cumulated volume of the granular elements (b) and the elements with a pozzolanic reaction (c); and e—at least one dispersing agent;

and meeting the following conditions: (1) the weight percentage of water E related to the cumulated weight of the cement (a) and the elements (c) is comprised in the range of 8-24%; (2) the fibers present an individual length L of at least 2 mm and a L/phi ratio, phi being the diameter of the fibers 20; (bis) the R ratio between the average length L of the fibers and the D75 particle size of all the constituents (a), (b), (c) and (d) is at least 5; 4) the quantity of fibers is such that their volume is lower than 4% of the volume of the concrete after setting; (5) all the constituents (a), (b), (c) and (d) present a D75 particle size of at most 2 mm and a D50 particle size of at most 200 μm preferably of at most 150 μm; or 7) the mixture of a—cement;

b—granular elements having a maximum particle size D of at most 2 mm;

c—fine elements with a pozzolanic reaction having a size of elementary particles of at most 20 μm;

d—at least one dispersing agent;

and meeting the following conditions: (e) the weight percentage of water related to the cumulated weight of the cement (a) and the elements (c) is comprised from 8 to 25%; (f) the organic fibers present an individual length L of at least 2 mm and a L/phi ratio, phi being the diameter of the fibers, of at least 20; (g) the R ratio between the average length L of the fibers and the maximum particle size D of the granular elements is at least 5, h) the quantity of fibers is such that their volume represents at most 8% of the volume of concrete after setting; or 8) the mixture of a—cement;

b—granular elements;

c—elements with a pozzolanic reaction having a size of elementary particles of at most 1 μm; and d—at least one dispersing agent;

and meeting the following conditions: 1) the weight percentage of water E related to the cumulated weight C of the cement (a) and the elements (c) is comprised in the range 8-24%; (2) the fibers present an individual length L of at least 2 mm and a L/phi ratio, phi being the diameter of the fibers, of at least 20; (3) the R ratio between the average length L of the fibers and the D75 particle size of all the constituents (a), (b) and (c) is at least 5, preferably at least 10; (4) the quantity of fibers is such that their volume is at most 8% of the volume of the concrete after setting; (5) all the constituents (a), (b) and (c) present a D75 particle size of at most 2 mm, preferably of at most 1 mm, and a D50 particle size of at most 150 μm; or 9) the mixture of:

a—at least one hydraulic binder from the group comprising the Portland cements class G (API), the Portland cements class H (API) and the other hydraulic binders with low levels of aluminates, b—a micro silica with a particle size distribution comprised in the range of 0.1 to 50 micrometers, at a rate of 20 to 35 weight % related to the hydraulic binder, c—an addition of average mineral and/or organic particles, with a particle size distribution comprised in the range 0.5-200 micrometers at a rate of 20 to 35 weight % related to the hydraulic binder, the quantity of the aforesaid addition of average particles being lower or equal to the quantity of micro silica, —a superplasticizing agent and/or a water soluble fluidizer in proportions comprised from 1 to 3 weight % related to the hydraulic binder, and water in amounts at most equal to 30% of the weight of the hydraulic binder; or 10) the mixture of:

a—cement;

b—granular elements having a Dg particle size of at most 10 mm;

c—elements with a pozzolanic reaction having a size of elementary particles comprised from 0.1 to 100 μm;

d—at least one dispersing agent;

e—metallic or organic fibers;

and meeting the conditions: (1) the weight percentage of water related to the cumulated weight of the cement (a) and the elements (c) is comprised in the range 8-24%; (2) the metallic fibers present an average length Lm of at least 2 mm, and a h/d1 ratio, d1 being the diameter of the fibers, of at least 20; (3) the Vi/V ratio of the volume Vi of the metallic fibers to the volume V of the organic fibers is higher than 1, and the Lm/Lo ratio of the length of the metallic fibers to the length of the organic fibers is higher than 1; (4) the R ratio between the average length Lm of the metallic fibers and the Dg size of the granular elements is at least 3; (5) the quantity of metallic fibers is such that their volume is lower than 4% of the volume of the concrete after setting and (6) the organic fibers present a melting temperature lower than 300° C., an average length Lo higher than 1 mm and a Do diameter of at most 200 μm, the quantity of organic fibers being such that their volume is comprised from 0.1 to 3% of the volume of the concrete.

16. A building comprising:

a barrier including a thermal insulating block, said thermal insulating block including a slot that extends from a first side of the thermal insulating block to a second side of the thermal insulating block, a layer of ultra-high performance fibered concrete integrated with the block and positioned on said first or second side of the block, and a reinforcement positioned in said slot and embedded in ultra-high performance fibered concrete in the slot, the reinforcement protruding from each of the first and second sides of the thermal insulating block, wherein a third side of the thermal insulating block defines an outer surface of the thermal barrier;

a wall; and a slab connected to the wall by the barrier.

17. The building according to claim 16, wherein the barrier is continuous between the slab and the wall, along an edge of the slab.

18. The building according to claim 16, wherein the thermal insulating block includes a plurality of slots that extend from the first side to the second side of the thermal insulating block, the barrier comprising a plurality of reinforcements positioned in the slots and embedded in ultra-high performance fibered concrete, and wherein the slab is fixed to the wall by the reinforcements of the barrier.

19. The building according to claim 16, wherein the thermal insulating block includes a plurality of slots that extend from the first side to the second side of the thermal insulating block, the barrier comprising a plurality of reinforcements positioned in the slots and embedded in ultra-high performance fibered concrete, and wherein the reinforcements of the barrier are in a lower half of the slab.

20. The building according to claim 16, further comprising an Indoor Thermal Insulation, comprising a lining complex comprising at least one gypsum board.

21. The building according to claim 16, wherein the third side of the thermal insulating block is adjacent to said first or second side.

22. A process for manufacturing a barrier comprising:

assembling a formwork defining a channel for a thermal insulating block;

forming a slot that extends from a first side of the thermal insulating block to a second side of the thermal insulating block;

pouring a layer of ultra-high performance fibered concrete on a side of the block and in the slot; and positioning a reinforcement in the slot so that only part of the reinforcement is covered by the ultra-high performance fibered concrete, wherein a third side of the thermal insulating block defines an outer surface of the thermal barrier.

23. The process according to claim 22, wherein there is a space between the block and a side of the channel, the ultra-high performance fibered concrete being poured in the space as well as on the block.

24. A thermal barrier comprising:

a thermal insulating block, said thermal insulating block including a slot that extends from a first side of the thermal insulating block to a second side of the thermal insulating block;

a layer of ultra-high performance fibered concrete integrated with the block and positioned on said first or said second side of the block; and a reinforcement positioned in said slot and extending from said first side to said second side, said reinforcement embedded in ultra-high performance fibered concrete in said slot, wherein a third side of the thermal insulating block forms an outer surface of the thermal barrier.

25. The barrier according to claim 24, wherein the third side is adjacent to said first side or said second side.

26. The barrier according to claim 24, wherein the reinforcement protrudes outwardly from said first side and said second side so that only part of the reinforcement is covered by concrete.

27. The barrier according to claim 24, wherein said first side or said second side of the thermal insulating block forms another outer surface of the thermal barrier and is partly devoid of a layer of concrete.

28. The barrier according to claim 24, wherein the layer of concrete substantially covers said first said or second side of the insulating block.

29. The barrier according to claim 24, wherein the thermal insulating block includes a plurality of slots that extend from the first side to the second side of the thermal insulating block, the barrier comprising a plurality of reinforcements positioned in the slots and extending from said first side to said second side, said reinforcements embedded in concrete in said slots.

30. The barrier according to claim 24, wherein said slot forms a groove on a surface of the thermal insulating block that extends from said first side to said second side.

* * * * *